US009125541B2

(12) United States Patent
Förster et al.

(10) Patent No.: US 9,125,541 B2
(45) Date of Patent: Sep. 8, 2015

(54) WASH ARM ARRANGEMENT FOR A DISHWASHER

(75) Inventors: Sarah Förster, Hamburg (DE); Anders Haegermarck, Trangsund (SE); Niklas Olson, Stockholm (SE)

(73) Assignee: Electrolux Home Products Corporation N.V., Brussels (BE)

( * ) Notice: Subject to any disclaimer, the term of this patent is extended or adjusted under 35 U.S.C. 154(b) by 0 days.

(21) Appl. No.: 13/699,438

(22) PCT Filed: May 10, 2011

(86) PCT No.: PCT/EP2011/057521

§ 371 (c)(1),
(2), (4) Date: Feb. 7, 2013

(87) PCT Pub. No.: WO2011/147682

PCT Pub. Date: Dec. 1, 2011

(65) Prior Publication Data

US 2013/0125936 A1 May 23, 2013

(30) Foreign Application Priority Data

May 25, 2010 (EP) ..... 10005408

(51) Int. Cl.
*A47L 15/18* (2006.01)
*A47L 15/20* (2006.01)
(Continued)

(52) U.S. Cl.
CPC ..... *A47L 15/23* (2013.01); *A47L 15/18* (2013.01); *A47L 15/20* (2013.01); *A47L 15/22* (2013.01)

(58) Field of Classification Search
USPC ..... 134/198
See application file for complete search history.

(56) References Cited

U.S. PATENT DOCUMENTS 1,314,622 A * 9/1919 Vaudreuil ..... 134/179
1,408,077 A 2/1922 Clinton
(Continued)

FOREIGN PATENT DOCUMENTS

CN 101095608 A 1/2008
DE 44 16 655 A1 11/1995
(Continued)

OTHER PUBLICATIONS

Mack, Friedrich, "EP 1634526 A2 English Machine Translation. pdf", Mar. 15, 2006—Machine translation from Espacenet.com.*
(Continued)

*Primary Examiner* — Joseph L Perrin
*Assistant Examiner* — Levon J Shahinian
(74) *Attorney, Agent, or Firm* — Alston & Bird LLP

(57) ABSTRACT

A wash arm arrangement (20) for a dishwasher is disclosed which has a central arm (21) adapted to be rotatably connected with a first shaft (23) through which liquid under pressure is fed into said central arm during operation. A satellite arm (22) is rotatably connected with a second shaft (24) arranged on the central arm, and which is arranged separated a first radial distance $r_{cs}$ from the axis of rotation of the central arm. The second shaft supplies liquid to the satellite arm during operation. To provide the liquid to a washing area of the dishwasher, the satellite arm comprises at least one outer nozzle (25) for providing liquid to a washing area of the dishwasher. The centre of the outer nozzle is arranged at a second radial distance $r_n$ with respect to the axis of rotation for the satellite arm which is at least equal to the first radial distance $r_{cs}$ minus half the width of the nozzle in a radial direction, and at most equal to the first radial distance $r_{cs}$ plus half the width of the nozzle in a radial direction. Thereby, an alternative and improved wash arm arrangement which has a high coverage of the washing area is achieved.

12 Claims, 3 Drawing Sheets

(51) Int. Cl.
*A47L 15/22* (2006.01)
*A47L 15/23* (2006.01)

(56) References Cited

U.S. PATENT DOCUMENTS

| | | | | |
|---|---|---|---|---|
| 3,496,949 | A * | 2/1970 | Mercer | 134/179 |
| 5,464,482 | A * | 11/1995 | Michael et al. | 134/25.2 |
| 5,477,874 | A * | 12/1995 | Yura et al. | 134/176 |
| 5,542,443 | A * | 8/1996 | Yura et al. | 134/176 |
| 6,263,888 | B1 * | 7/2001 | Nomura et al. | 134/57 D |
| 2007/0289615 | A1 | 12/2007 | Shin | |

FOREIGN PATENT DOCUMENTS

| | | |
|---|---|---|
| EP | 1 634 526 A2 | 3/2006 |
| JP | 7-163505 | 6/1995 |
| JP | 7-250799 | 10/1995 |

OTHER PUBLICATIONS

International Search Report for Application No. PCT/EP2011/057521 dated Feb. 2, 2012.

Extended European Search Report from Application No. 10005408.9 dated Sep. 23, 2010.

International Search Report for Application No. PCT/EP2011/060151, dated Dec. 28, 2011.

European Search Report for Application No. EP 10006451.8, dated Feb. 4, 2011.

* cited by examiner

WASH ARM ARRANGEMENT FOR A DISHWASHER

CROSS REFERENCE TO RELATED APPLICATIONS

This application is a national stage application filed under 35 U.S.C. 371 of International Application No. PCT/EP2011/057521, filed May 10, 2011, which claims priority from European Patent Application No. 10005408.9, filed May 25, 2010, each of which is incorporated by reference herein in its entirety.

TECHNICAL FIELD

The present invention relates to a wash arm arrangement for a dishwasher, and more particularly to a wash arm arrangement comprising a satellite arm arranged on a central arm.

BACKGROUND OF THE INVENTION

Most conventional dishwashers are arranged having single wash arm arrangements comprising a central arm which is provided with a plurality of spray nozzles arranged along the extension of the central arm for sufficient covering of the washing area of the treatment chamber with cleaning liquid and optionally for driving the central arm. The central arm is rotatably connected with a supply shaft for supply of cleaning liquid, e.g. water, about which supply shaft the central arm revolves while water is spread within the treatment chamber of the dishwasher.

Further, wash arm arrangements with an additional second arm, herein after referred to as a satellite arm, arranged on one or both of the outer ends of the central arm are known. EP1 634 526 A discloses a wash arm arrangement for a dishwasher, having a central arm onto which a satellite arm is arranged. The central arm is attached at one end to a hollow central shaft which serves as a water and rinsing fluid supply duct. The central arm can be positioned either at the bottom or at the ceiling of the dishwasher treatment chamber. A spray arm is swivel mounted with its center to the outer end of the central arm thereby forming a satellite arm. The spray arm is provided with several nozzles at both ends. The nozzles are arranged having different spray angles for covering the different areas of the washing area of the treatment chamber with cleaning liquid and for driving the spray arm. When the cleaning liquid is released a thrust is created moving both arms in circles around their individual axis of rotation. Thereby, cleaning liquid from the nozzles of the rotating satellite arm is provided in different angles for high covering of the washing area.

SUMMARY

In view of the above, an objective of the invention is to provide an alternative and improved wash arm arrangement which provides high coverage of the washing area.

According to a first aspect of the present invention, there is provided a wash arm arrangement for a dishwasher comprising a central arm adapted to be rotatably connected with a first shaft through which liquid under pressure is fed into the central arm during operation, and at least one satellite arm having a liquid inlet. The liquid inlet is rotatably connected with a second shaft for supplying liquid to the satellite arm during operation, and the satellite arm comprises at least one nozzle for providing liquid to a washing area of the dishwasher. The second shaft is arranged on the central arm such that an axis of rotation of the satellite arm is separated a first radial distance $r_{cs}$ from the axis of rotation of the central arm. The centre of an outer nozzle, being a nozzle selected from the at least one nozzle which is positioned at the largest distance from the second shaft, is arranged at a second radial distance $r_n$ with respect to the axis of rotation for the satellite arm which is at least equal to the first radial distance $r_{cs}$ minus half the width of the nozzle in a radial direction, and at most equal to the first radial distance $r_{cs}$ plus half the width of the nozzle in a radial direction.

Thus, there is provided a wash arm arrangement for a dishwasher which has at least an outer nozzle provided on the satellite arm, which outer nozzle is arranged such that during operation, the washing area is subjected to a most outer trace of cleaning liquid due to the rotation locus of the outer nozzle which trace passes over the axis of rotation for the central arm, or which outer rim tangents the axis of rotation, thus providing a coverage over a larger portion of the washing area. This is particularly advantageous for wash arm arrangements which have only a few nozzles arranged on the surface of the satellite arm which faces the washing area.

According to an embodiment of the wash arm arrangement, the second radial distance $r_n$ is equal to the first radial distance $r_{cs}$ between the axis of rotation for said satellite arm and the axis of rotation of said central arm.

According to an embodiment of the wash arm arrangement, the outer nozzle is arranged at an outer end of the satellite arm, which is advantageous for the purpose of covering as large washing area inside the washing compartment as possible.

According to an embodiment of the wash arm arrangement, one nozzle, not being the outer nozzle, is arranged on an opposite side of the liquid inlet, at a radial distance with respect to the axis of rotation for the satellite arm which is less than said second radial distance $r_n$. This is advantageous for providing a combined set of rotating traces, which in addition to the advantages described above, has an increased liquid jet or liquid spray trace density at a predetermined portion of the washing area for an arrangement with only two nozzles.

According to an embodiment of the wash arm arrangement, at least one of the nozzles is arranged to provide a propulsion force for driving at least the rotation of the satellite arm around its axis of rotation during operation. The nozzles may in addition to the functionality of providing cleaning liquid for loosening of soil from the dishes in the washing area be arranged to simultaneously drive the rotation of the wash arm arrangement. This way the amount of liquid needed to drive the wash arm arrangement is minimized with a retained high enough liquid pressure and in addition a high enough liquid flow to ensure a good cleaning result. The liquid flow needs to be high enough to provide disposal of loosened soil from the washing area.

According to an embodiment of the wash arm arrangement, at least the outer nozzle is skewed. By skewing the nozzles, the liquid traces formed by the rotating nozzles during operation can be directed to form a desired trace pattern which is advantageous for covering the washing area. Further, the skew of individual nozzles may be selected to separate directions such that the dishes are subjected to different angles of impact of the liquid, which increases the provided cleaning performance.

According to an embodiment of the wash arm arrangement, the outer nozzle is skewed between 2-20° with respect to the vertical plane of the satellite arm, which is advantageous.

According to an embodiment of the wash arrangement, at least the outer nozzle is skewed with respect to a direction along the extension of the satellite arm and with respect to a direction perpendicular to the extension of the satellite arm. Thereby, a propulsion force for driving the satellite arm rotation, and a predetermined trace pattern can be achieved simultaneously.

According to a second aspect of the invention, there is provided a dishwasher comprising at least one wash arm arrangement according to the invention, which has the advantages as presented above.

Generally, all terms used in the claims are to be interpreted according to their ordinary meaning in the technical field, unless explicitly defined otherwise herein. All references to "a/an/the [element, device, component, means, step, etc]" are to be interpreted openly as referring to at least one instance of the element, device, component, means, step, etc., unless explicitly stated otherwise. The steps of any method disclosed herein do not have to be performed in the exact order disclosed, unless explicitly stated.

Other objectives, features and advantages of the present invention will appear from the following detailed disclosure, from the attached dependent claims as well as from the drawings.

BRIEF DESCRIPTION OF THE DRAWINGS

The above, as well as additional objects, features and advantages of the present invention, will be better understood through the following illustrative and non-limiting detailed description of preferred embodiments of the present invention, with reference to the appended drawings, where the same reference numerals will be used for similar elements, wherein.

DETAILED DESCRIPTION OF PREFERRED EMBODIMENTS

Figure 1:
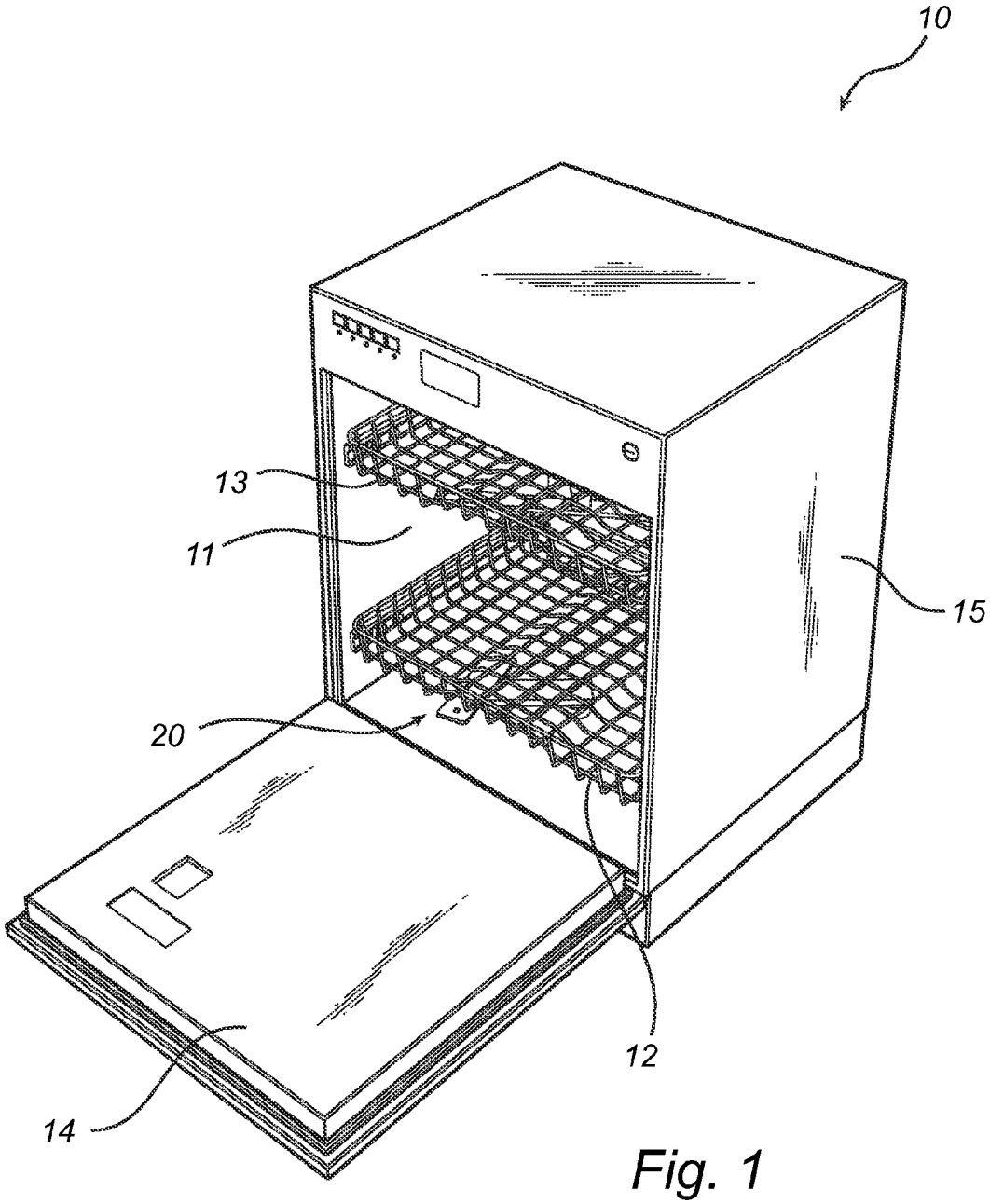
FIG. 1 is a perspective view of a dishwasher according to the present invention.

A dishwasher 10 according to the invention, as illustrated in FIG. 1, comprises a housing 15 in which a treatment chamber 11 is arranged. The treatment chamber 11 has a lower and an upper basket, 12 and 13, in which dish is inserted. Below or/and above each basket 12 and 13, one or more wash arm arrangements 20 are arranged. The wash arm arrangements 20, are adapted to rotate substantially horizontal during operation of the dishwasher 10. Each wash arm arrangement is connected to a respective liquid supply duct, via which duct a circulation pump distributes liquid under pressure during operation of the dishwasher (not visible in FIG. 1). Further, a door 14 for sealing the treatment chamber 11 is arranged on the housing 15.

Figure 2:
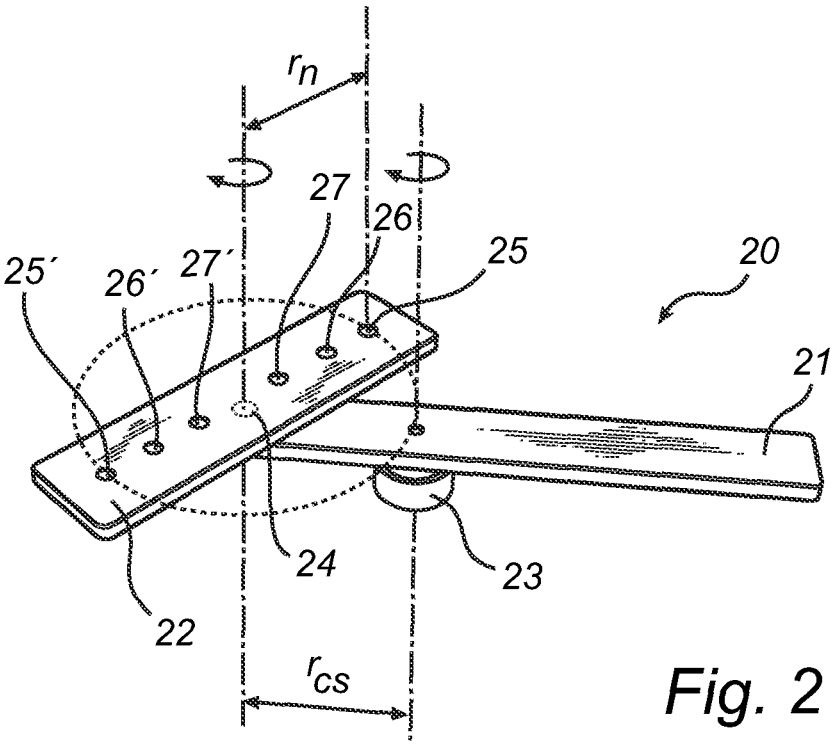
FIG. 2 is a perspective view of an embodiment of a wash arm arrangement according to the present invention.

An embodiment of a wash arm arrangement 20 according to the present invention is now described, with reference to FIG. 2. The wash arm arrangement 20 comprises a hollow and elongated central arm 21 having an upper and lower side, which central arm 21 has a liquid inlet at a first shaft alley 23 arranged on the lower side of the central arm 21. The first shaft alley 23 is adapted for rotatable connection with a water supply duct vertically arranged in the treatment chamber of the dishwasher (not shown). Thus, the rotation center, or axis of rotation, of the central arm 21 is located at the center of the liquid inlet 23. The liquid inlet may in an alternative embodiment of an elongated hollow central arm be arranged in an end portion of the elongated body. However, for balancing purposes, the liquid inlet, i.e. the shaft alley 23, is preferably arranged at the mass centre of the wash arm arrangement, to achieve balance during operation of the dishwasher, which is advantageous with respect to avoiding unwanted acoustic resonance, and to avoiding mechanical stress in the shaft alley thereby increasing the lifetime of the mechanical parts.

To continue, the central arm 21 is provided with a liquid outlet via a second shaft alley 24. The second shaft alley 24 is arranged on the upper side of the central arm 21 and at an end portion of the central arm 21. Further, an elongated satellite arm 22 is rotatably connected at a liquid inlet with the second shaft alley 24. The central arm 21 is here substantially overall hollow. However, the central arm may alternatively be partly hollow, as long as a liquid supply channel is provided between the first shaft alley and the second shaft alley thereby providing fluid communication between the first and second shaft alley. In the same manner, the satellite arm 22 is at least partly hollow and receives cleaning liquid via the second shaft 24 during operation of the dishwasher.

To provide the cleaning liquid to the washing area of the dishwasher nozzles, 25, 25'-27, 27', are arranged at an upper surface of the satellite arm 22, which upper surface faces the intended washing area of the dishwasher, i.e. one of the baskets, 12 or 13, in FIG. 1. Typically, the nozzles are arranged on a surface that is opposite to the liquid inlet of the satellite arm 22 which is connected with the second shaft 24. The satellite arm 22 is arranged such that the radial distance, $r_n$, between the most outer nozzle 25, 25' and the axis of rotation of the satellite arm 22 is equal to the radial distance, $r_{cs}$, between the axis of rotation for the satellite arm 22 and the axis of rotation for the central arm 21. During operation cleaning liquid under pressure is distributed to the wash arm arrangement 20 from the dishwasher feeding duct via the first shaft alley 23 and into the central arm 21 and further through the second shaft alley 24 into the satellite arm 22. Cleaning liquid is forced out through each nozzle 25, 25'-27, 27', thereby subjecting the washing area to a respective cleaning liquid jet or sprinkle tracing an orbiting path around the axis of rotation of the satellite arm 22, which axis of rotation of the satellite arm 22 is simultaneously orbiting the axis of rotation of the central arm 21.

Figure 3A:
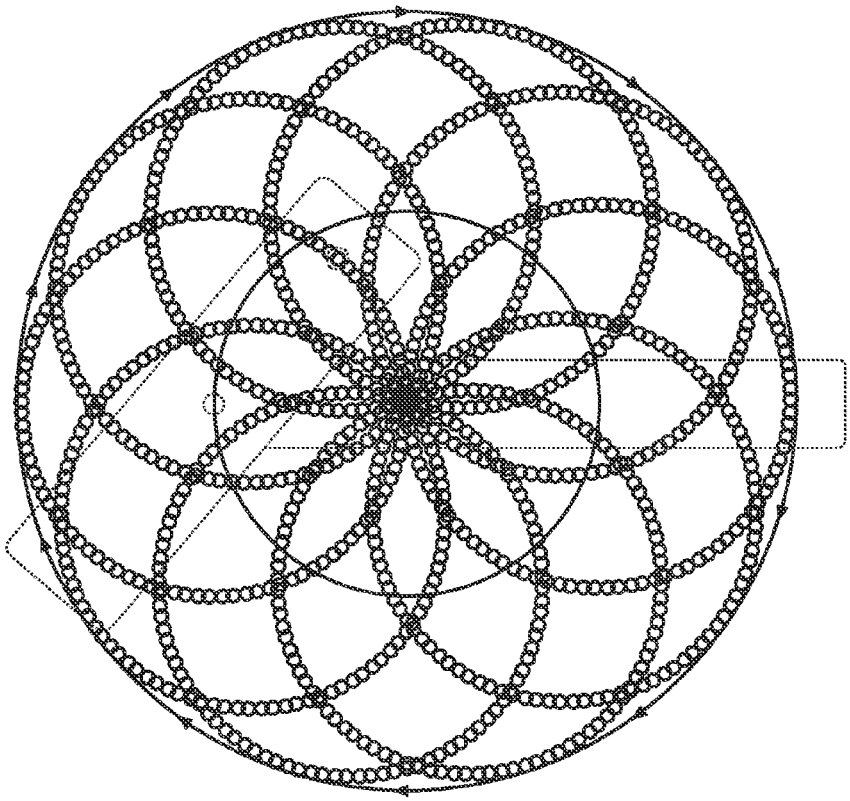
FIG. 3*a* is a view showing the rotation locus of the outer nozzle of an embodiment of a wash arm arrangement according to the present invention.
Figure 3B:
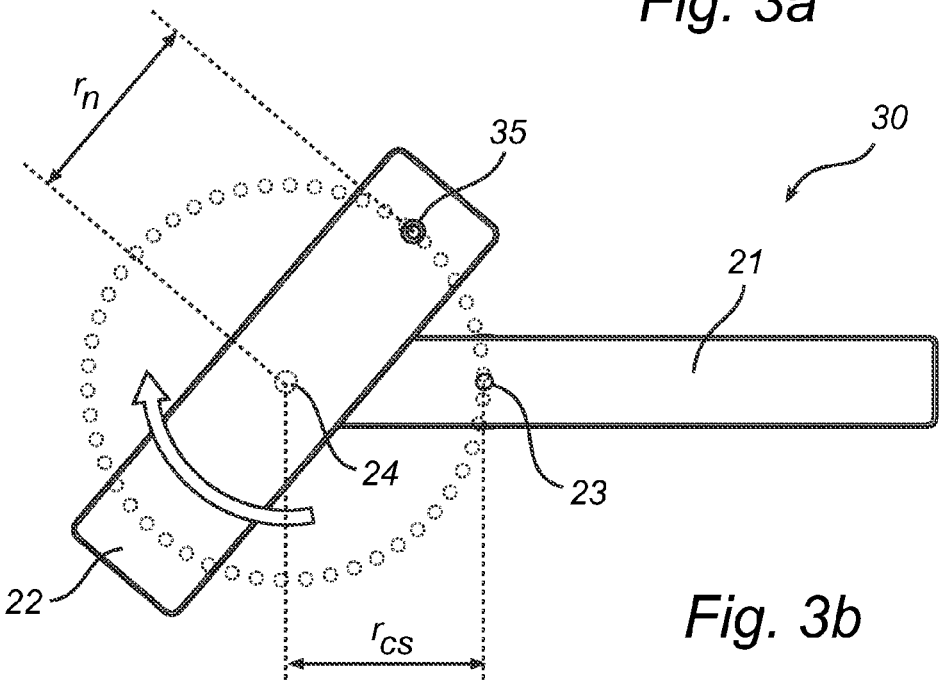
FIG. 3*b* is a top view of an embodiment of a wash arm arrangement of the present invention.

In an embodiment of a wash arm arrangement 30 according to the present inventive concept, as illustrated in FIG. 3*b*, the wash arm arrangement 30 comprises a central arm 21 and a satellite arm 22 arranged basically in the same manner as in the embodiment as previously described with reference to FIG. 2. However, the satellite arm 22 has only one single outer nozzle 35 arranged on an outer portion of its elongated body. The radial distance $r_n$ between the position of the outer nozzle and the second shaft allay is equal to the distance $r_{cs}$ between the first and second shaft alleys. The resulting cleaning liquid path over the washing area caused by the combined rotation of the central arm 21 about the first shaft alley 23, and the rotation of the satellite arm 22 about the second shaft alley 24 is schematically illustrated in FIG. 3*a*, which is a view showing the rotation locus of the outer nozzle when the ratio $r_n/r_{cs}$ is 1.The wash arm arrangement is arranged such that for every revolution of the central arm the rotation locus of the outer nozzle is displaced. The washing area is thus subjected to a jet or sprinkle of cleaning liquid which for every revolution of the satellite arm passes over a larger subarea of the washing area than for a known satellite arm arrangement.

In an embodiment of the wash arm arrangement, not shown, the wash arm arrangement comprises a central arm and a satellite arm arranged basically as in the embodiment as described with reference to FIG. 3*b*. However, the outer nozzle which is arranged on an outer portion of the elongated body of the satellite arm positioned such that the centre of the outer nozzle is arranged at a radial distance $r_n$ with respect to the axis of rotation for the satellite arm which is equal to the first radial distance $r_{cs}$ minus half the width of the nozzle in a radial direction. The cleaning liquid path over the washing area caused by the combined rotation of the central arm about the first shaft alley, and the rotation of the satellite arm about the second shaft alley results in the washing area being subjected to jet or sprinkle of cleaning liquid which for every revolution of the satellite arm border over the area at the axis of rotation for the central arm providing a high trace density of the cleaning liquid distribution at this area.

In an embodiment of the wash arm arrangement (not shown), the radial distance $r_n$ for the outer nozzle with respect to the axis of rotation for the satellite arm is equal to the first radial distance $r_{cs}$ plus half the width of the outer nozzle in a radial direction. The cleaning liquid path over the washing area caused by the combined rotation of the central arm about the first shaft alley, and the rotation of the satellite arm about the second shaft alley results in the washing area being subjected to jet or sprinkle of cleaning liquid which for every revolution of the satellite arm border over the area at the axis of rotation for the central arm providing a high trace density of the cleaning liquid distribution at this area.

A sufficient covering of the washing area and trace density of the jet or spray is achieved when the radial distance $r_n$ is selected within a range of.

$$r_n = r_{cs} \pm d_n/2,$$

where $d_n$ is the width of the outer nozzle in a radial direction, i.e. the diameter of the nozzle when the nozzle is circular.

In embodiments of the wash arm arrangement, the nozzle is skewed such that the trace of cleaning liquid during operation is further controlled. It is advantageous to arrange the radial distance $r_n$ selected within the range as defined above, while directing the jet or spray to incline an angle having a component in the direction towards the center of rotation of the satellite arm. Thereby, the washing area is hit by the jet or spray trace, and the loss of water which is spread towards the inner walls of the treatment chamber is decreased. This provides an increased cleaning effect and has a positive effect on the acoustic image of the dishwasher.

In an embodiment according to the present invention, the rotation locus of the outer nozzle and an additional single inner nozzle are combined to provide a high density power of the cleaning liquid distribution to the washing area. When having a satellite arm that extends symmetrically from its axis of rotation, the single inner nozzle can be arranged on an opposite side of the axis of rotation to balance the satellite arm. An individual skewing direction of the respective inner and outer nozzle is applicable which can be utilized to balance the satellite arm during operation.

The parts of the wash arm arrangement according to the present inventive concept is preferably manufactured by molding the whole parts or sub portions of the parts utilizing a suitable plastic material. The sub portions are then put together by means of e.g. ultrasonic welding. However, other suitable materials such as stainless steel etc. may be used to manufacture the wash arm arrangement.

The present inventive concept, is even if it is applicable to multiple nozzle washing arm arrangements with spray nozzles, especially well suited for wash arm arrangements with a single nozzle or a very low number of nozzles due to the improved covering of the washing area.

In an embodiment of the wash arm arrangement, one or more nozzles are skewed such that the jet outputted from the nozzle is inclined with respect to the vertical plane of the upper surface of the satellite arm. During operation cleaning liquid under pressure is distributed to the wash arm arrangement from the dishwasher feeding duct via the first shaft alley and into the central arm and further through the second shaft alley into the satellite arm. Cleaning liquid is forced out through the nozzles. One of the nozzles is skewed 10° with respect to the vertical plane of extension of the satellite arm and aimed in a direction perpendicular to the extension of the satellite arm, such that the jet under pressure being outputted from the nozzle is inclined providing a propulsion force such that the satellite arm is rotated. To provide a propulsion force a skewing of at least one nozzle within the range of 2-20° is applicable.

Above, embodiments of the wash arm arrangement according to the present invention as defined in the appended claims have been described. These should be seen as merely non-limiting examples. As understood by a skilled person, many modifications and alternative embodiments are possible within the scope of the invention.

It is to be noted, that for the purposes of this application, and in particular with regard to the appended claims, the word "comprising" does not exclude other elements or steps, that the word "a" or "an", does not exclude a plurality, which per se will be apparent to a person skilled in the art.

The invention claimed is:

1. Wash arm arrangement for a dishwasher comprising:

a central arm adapted to be rotatably connected with a first shaft through which liquid under pressure is fed into said central arm during operation; and at least one satellite arm having a liquid inlet, said liquid inlet being rotatably connected with a second shaft for supplying liquid to said satellite arm during operation, and said satellite arm comprising at least one nozzle for providing liquid to a washing area of said dishwasher; wherein said second shaft is arranged on said central arm such that an axis of rotation of said satellite arm is separated a first radial distance $r_{cs}$ from the axis of rotation of said central arm, wherein the centre of an outer nozzle, being a nozzle selected from said at least one nozzle which is positioned at the largest distance from said second shaft, is arranged at a second radial distance $r_n$ with respect to the axis of rotation for said satellite arm which is at least equal to said first radial distance $r_{cs}$ minus half the width of said nozzle in a radial direction, and at most equal to said first radial distance $r_{cs}$ plus half the width of said nozzle in a radial direction, and wherein the outer nozzle is skewed and adapted to direct a spray of cleaning liquid with a component in the direction towards a center of rotation of the satellite arm, and wherein a spray pattern of liquid to the washing area passes upwardly through the axis of rotation of said central arm on each rotation of the satellite arm.

2. Wash arm arrangement according to claim 1, wherein said second radial distance $r_n$ is equal to the first radial distance $r_{cs}$ between the axis of rotation for said satellite arm and the axis of rotation of said central arm.

3. Wash arm arrangement according to claim 1, wherein said outer nozzle is arranged at an outer end of said satellite arm.

4. Wash arm arrangement according to claim 1, wherein one nozzle, not being the outer nozzle, is arranged on an opposite side of said liquid inlet, at a radial distance with respect to the axis of rotation for said satellite arm which is less than said second radial distance $r_n$.

5. Wash arm arrangement according to claim 1, wherein at least one of said nozzles is arranged to provide a propulsion force for driving at least the rotation of said satellite arm around its axis of rotation during operation.

6. Wash arm arrangement according to claim 1, wherein at least said outer nozzle is skewed.

7. Wash arm arrangement according to claim 6, wherein said outer nozzle is skewed between 2-20° with respect to a vertical plane of said satellite arm defined by an axis co-extensive with the axis of rotation of the satellite arm and an axis defined by the extension of the satellite arm.

8. Wash arm arrangement according to claim 7, wherein at least the outer nozzle is skewed with respect to a direction along the extension of the satellite arm and with respect to a direction perpendicular to the extension of the satellite arm and perpendicular to the vertical plane.

9. Wash arm arrangement according to claim 1, wherein the wash arm arrangement is arranged such that for every revolution of the central arm, a rotation locus of the outer nozzle is displaced.

10. A dishwasher comprising at least one wash arm arrangement according to claim 1.

11. Wash arm arrangement according to claim 1, wherein the outer nozzle is arranged such that during operation, the washing area is subjected to a path of cleaning liquid, wherein the path passes over the axis of rotation for the central arm, or passes adjacent to the axis of rotation of the central arm.

12. The wash arm arrangement of claim 1, wherein the washing area comprises an area in which dishes are received, and wherein the spray pattern is directed into the wash area along the axis of rotation of the central arm on each rotation of the satellite arm.

* * * * *